US005441450A

United States Patent [19]

Fein et al.

[11] Patent Number: 5,441,450

[45] Date of Patent: Aug. 15, 1995

[54] POWER TOOL HAVING MEANS TO SWITCH FROM OSCILLATORY MOVEMENT TO ROTARY MOVEMENT

[75] Inventors: Hans W. Fein; Andreas Peisert, both of Stuttgart, Germany

[73] Assignee: C.&E. Fein GmbH & Co., Stuttgart, Germany

[21] Appl. No.: 237,754

[22] Filed: May 4, 1994

[30] Foreign Application Priority Data

May 5, 1993 [DE] Germany ..... 43 14 799.2

[51] Int. Cl.[6] ..... B24B 23/02

[52] U.S. Cl. ..... 451/357; 451/344; 451/356

[58] Field of Search ..... 451/163, 174, 175, 344, 451/351, 353, 356, 357, 359

[56] References Cited

U.S. PATENT DOCUMENTS

| | | | |
|---|---|---|---|
| 4,920,702 | 5/1990 | Kloss et al. | 51/170 R |
| 5,018,314 | 5/1991 | Fushiya et al. | 451/357 |
| 5,040,340 | 8/1991 | Bischof et al. | 451/357 |
| 5,123,216 | 6/1992 | Kloss et al. | 51/170 MT |

FOREIGN PATENT DOCUMENTS

| | | |
|---|---|---|
| 0244465 | 8/1989 | European Pat. Off. . |
| 0372376 | 11/1989 | European Pat. Off. . |
| 0525328 | 5/1992 | European Pat. Off. . |
| 3629333 | 3/1988 | Germany . |
| 3840974 | 12/1988 | Germany . |
| 9030311 | 3/1990 | Germany . |
| 8702924 | 5/1987 | WIPO . |

*Primary Examiner*—Bruce M. Kisliuk
*Assistant Examiner*—Eileen P. Morgan
*Attorney, Agent, or Firm*—Weil, Gotshal & Manges

[57] ABSTRACT

A power tool, especially a handheld sander, is described, possessing a motor-driven drive shaft that can be alternatively coupled either by means of an oscillation drive to an oscillatory tool drive shaft, or by means of a rotary drive to a rotary tool receptacle coaxial with the oscillatory tool drive shaft. Switching is provided by a switching element, in a first switch position of which the drive shaft is driven in an oscillating manner about the lengthwise axis of the oscillatory tool drive shaft, with a small pivot angle and at high frequency, by means of the oscillation drive, which can consist for example of an eccentric element on the tool drive shaft and a pivot element guided slidingly thereon and fastened on the tool drive shaft. In the second switch position of the switching element, however, the working engagement of the oscillation drive is abolished, and the tool receptacle is rotationally driven by the drive shaft by means of a bevel gear linkage.

14 Claims, 1 Drawing Sheet

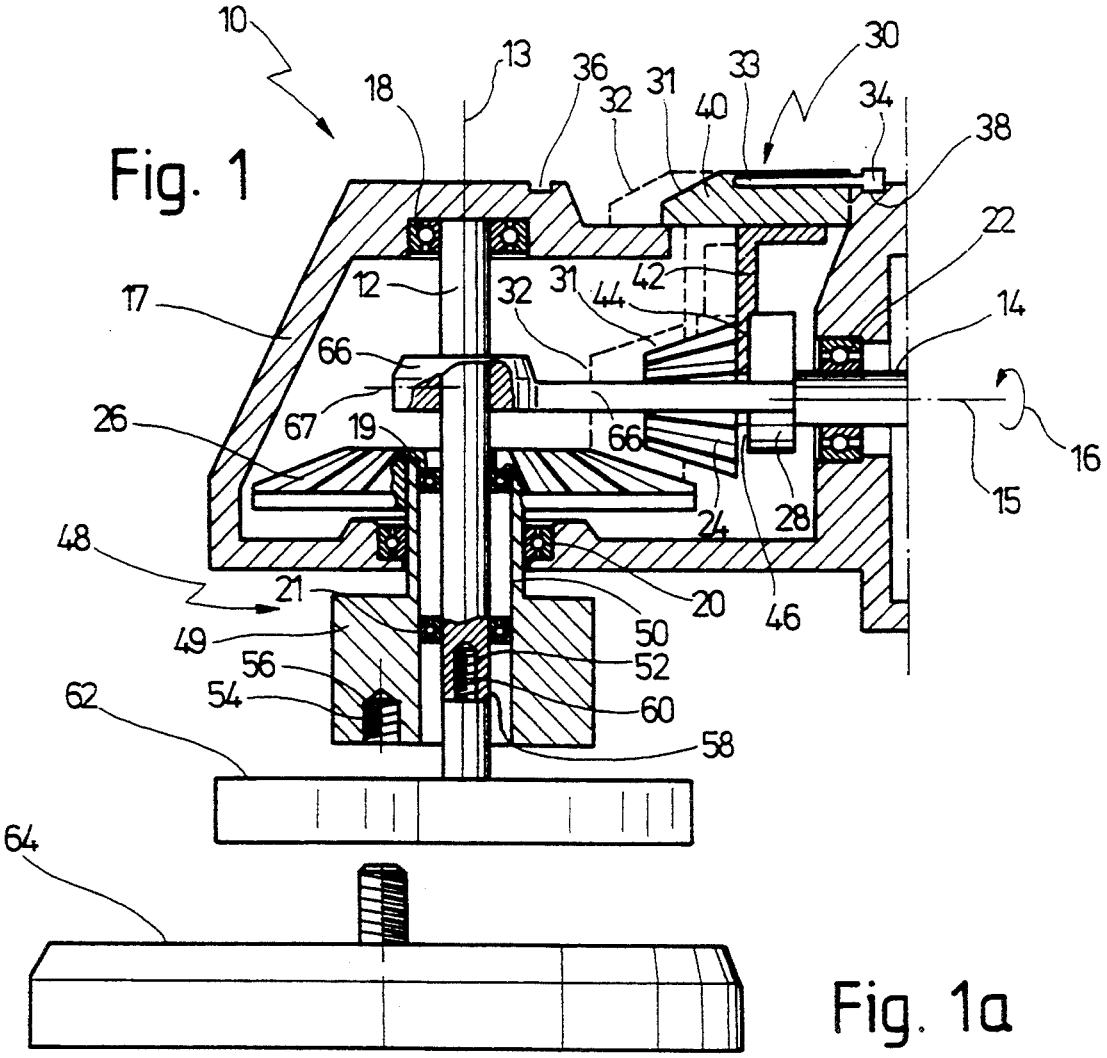
Fig. 1
Fig. 1a
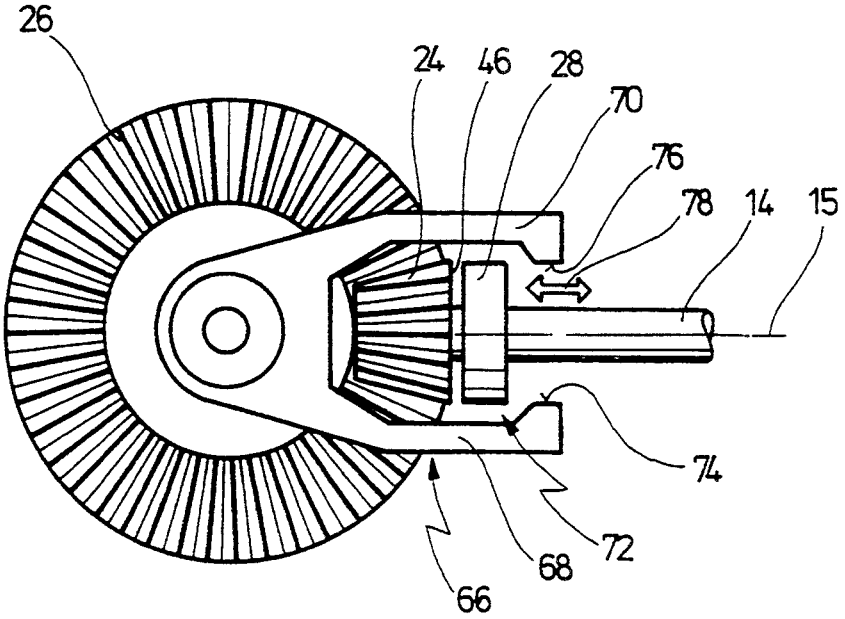
Fig. 2

POWER TOOL HAVING MEANS TO SWITCH FROM OSCILLATORY MOVEMENT TO ROTARY MOVEMENT

BACKGROUND

The invention relates to a power tool with an oscillation drive for tools with a motor-driven drive shaft that can be coupled via an oscillation drive to an oscillatory tool drive shaft in order to drive a tool in such a way that the tool is driven in an oscillating manner about a pivot axis.

A power tool of this kind is known from EP-0 244 465 B1.

In the known power tool, a sanding tool, which preferably possesses a polygonal, especially triangular, workingsurface, can be driven is driven in an oscillating manner, at high frequency and with a small pivot angle, about a pivot axis fixed to the unit.

A sanding tool of this kind is particularly suitable for sanding in corners and in poorly accessible locations.

For sanding larger surfaces, however, in most cases sanders are used whose sanding tool is driven rotationally and eccentrically. Such sanders are known as "orbital sanders" and are widely used. In this connection the sanding tool usually takes the form of a sanding disk. EP-0 525 328 A1 has furthermore disclosed an orbital sander whose sanding disk is driven by a rotating drive motor and via an eccentric cam, with no forced rotation. The sanding disk can be fastened to the housing at a point such that rotary motion of the sanding disk is prevented, without impeding its eccentric displacement. As a result, in this position the orbital sander executes a vibratory motion.

Although an orbital sander of this kind is suitable for sanding larger surfaces, this type of sanding unit is of only limited suitability for sanding along lengthwise edges or in corners, even after being switched to the vibratory motion.

OBJECTS OF THE INVENTION

The underlying object of the invention is therefore to create a power tool that can be used in as many ways as possible. In particular, the intention is to improve a power tool of the aforesaid type so as to allow sanding along lengthwise edges and in corners, and to allow surface working of large sanding areas.

SUMMARY OF THE INVENTION

According to the invention, this object is achieved by the fact that in a power tool of the aforesaid type, a rotary drive is provided by means of which the drive shaft can be coupled to the tool in such a way that the tool is rotationally driven; that a switching element with at least two switch positions, which interacts with the oscillation drive and the rotary drive, is provided; that in a first switch position of the switching element, the oscillation drive is coupled to the tool to provide oscillating drive for the oscillatory tool about a pivot axis-;and that in a second switching position of the switching element, the rotary drive is coupled to the rotary tool to provide rotational drive for the tool.

In this manner, the invention creates the possibility of linking the advantages of an oscillation drive for oscillating drive of a tool about a pivot axis, with the advantages of a rotational drive for a tool. Thus one and the same sander can be used to work optimally both along lengthwise edges, in corners, and in other poorly accessible locations, while at the same time after the switching element is switched into the second switch position, the power tool can be driven rotationally. In the second switch position, therefore, the power tool can, for example, be used as a right-angle sander with a sanding wheel or cutoff wheel in order to perform coarse sanding tasks or cutting tasks, while the first switch position allows finish sanding in poorly accessible locations. Since the advantages of two different power tools are combined in one power tool in this manner, this leads to a considerable cost saving and makes it possible to utilize a single universal tool instead of two different power tools.

In a preferred embodiment of the invention, in the first switch position the drive shaft is coupled to the oscillatory tool drive shaft, and in the second switch position is coupled, via the rotary drive, to a tool receptacle to drive the tool rotationally.

While it would also theoretically be possible to provide a common mount to receive the oscillatory and the rotary tool for an oscillating or rotational drive, in this manner either the oscillatory tool drive shaft is coupled, in the first switching position, to the drive shaft for oscillating drive, or, in the second switching position of the switching element, the drive shaft is coupled via the rotary drive to the rotary tool receptacle so as to drive the tool rotationally. If the tool is to be driven rotationally, it thus needs to be mounted on the rotary tool receptacle; if, on the other hand, it is to be driven in an oscillating manner, it must be mounted on the oscillatory tool drive shaft.

In an advantageous embodiment of the invention, the oscillatory tool drive shaft is oriented perpendicular to the drive shaft; the oscillation drive comprises an eccentric element attached non-rotatably to the drive shaft and a pivot element attached non-rotatably to the oscillatory tool drive shaft; and in the first switch position of the switching element the pivot element is driven by the eccentric element in such a way that the oscillatory tool drive shaft is moved in an oscillating manner about its pivot axis, at high frequency and with a small pivot angle.

The advantage of this feature is that oscillation drive can be achieved in a particularly simple and cost-effective way.

In a further advantageous embodiment of the invention, a drive pinion is attached non-rotatably to the drive shaft and an output gear is attached non-rotatably to the rotary tool receptacle; in the second switch position of the switching element, the drive pinion meshes with the output gear in order to drive the rotary tool receptacle rotationally about its lengthwise axis, while the pivot element is not in working engagement with the eccentric element of the drive shaft.

The advantage of this feature is that rotational drive for the tool can again be achieved in a particularly simple manner.

In a further embodiment of the invention, the tool receptacle is configured coaxially with the tool drive shaft, and mounted rotatably with respect thereto.

This results in a simple and space-saving design.

In an additional embodiment of the invention, the rotary tool receptacle is non-rotatably attached to the output gear by means of a hollow shaft rotatably mounted on the oscillatory tool drive shaft.

This also simplifies the design of the arrangement according to the invention. The follow shaft can be rigidly and non-rotatably attached to the tool receptacle and the output gear, for example bolted to them or configured integrally with them.

According to a further feature of the invention, the rotary tool receptacle carries a mount, offset from the lengthwise axis of the tool drive shaft, to receive the tool, so as to drive the tool in eccentric rotation about the lengthwise axis in the second switch position of the switching element.

In this manner an eccentric motion can be additionally super-imposed on the rotary motion, so that the power tool on the one hand is usable as an orbital sander for advantageous sanding of large surfaces, and on the other hand can be used as an oscillating sander for sanding along lengthwise edges, and for sanding in corners and other poorly accessible locations.

In a further embodiment of the invention, the oscillatory tool drive shaft possesses central mount, coaxial with the lengthwise axis of the tool drive shaft, to receive the tool so as to drive the tool in an oscillating manner about the lengthwise axis.

According to this feature of the invention, two separate mounts, offset laterally from one another, ere provided for the oscillatory and the rotary tools. One mount, which extends through the lengthwise axis of the oscillatory tool drive shaft, is provided to receive sanding tools that are driven in an oscillating manner, while the other receptacle, offset laterally from this receptacle, is provided to mount a grinding tool driven in eccentric rotation.

Theoretically, switching between the two drive modes—oscillation drive or rotational drive—can be implemented in a variety of ways.

It has proven to be particularly advantageous, however, if the drive shaft is designed to be displaceable along its lengthwise axis, so as either (in the first switch position) to bring the pivot element into engagement with the eccentric element or (in the second switch position) to bring the drive pinion into engagement with the output gear.

This embodiment of the device for switching between the two drive modes results in a simple configuration and reliable switching capability.

In an additional development of the invention, the drive pinion is held non-rotatably, next to the eccentric element and spaced away from it by a gap, at the end of the drive shaft facing the oscillatory tool drive shaft; and the switching element comprises a projection, engaging into the gap, by means of which the drive shaft can be axially displaced along its lengthwise axis.

This configuration again further simplifies the design of the device for switching between the two drive modes, and allows reliable switching.

In an additional development of the invention, the pivot element is configured as a pivot fork, with two pivot arms lying opposite one another, that is non-rotatably held on the tool drive shaft, such that the two pivot arms face the drive shaft, such that there is formed between the two pivot arms a recess within which the drive pinion and the eccentric element can be displaced together with the drive shaft, such that each of the two pivot arms has a sliding surface facing inward toward the lengthwise axis of the drive shaft, such that in the first switch position, the sliding surfaces surround the eccentric element externally and are in sliding contact with it, and such that in the second switch position, the drive shaft is displaced toward the oscillatory tool drive shaft so that the eccentric element can rotate freely within the recess, while the drive pinion meshes with the output gear.

In this embodiment of the invention, oscillation drive is thus implemented by the fact that the pivot element is guided by its two sliding surfaces on the exterior of the eccentric element, so that when the eccentric element rotates, the oscillation element is made to oscillate about the oscillatory tool drive shaft which is arranged perpendicular to the drive shaft. In this embodiment, the drive pinion and output gear constitute a bevel gear linkage, with which it is known that reliable power transfer can be implemented. In this configuration, the design of the oscillation drive is also as simple and reliable as possible.

According to a further feature of the invention, the switching element can be locked in both switch positions.

This prevents the switching element from inadvertently being released while the power tool is operating, which might undesirably initiate the switching process during operation.

In an advantageous development of the invention, the rotary tool is a sanding disk, while the oscillatory tool is a sanding tool with a polygonal, in particular triangular, sanding surface.

It is understood that the features mentioned above and those yet to be explained below can be used not only in the respective combinations indicated, but also in other combinations or in isolation, without leaving the context of the present invention.

Further advantages and features of the invention are evident from the description below of a preferred exemplary embodiment, with reference to the drawings, in which:

DESCRIPTION OF THE DRAWINGS

FIG. 1 shows a lengthwise section through a power tool according to the invention in a simplified representation; for the sake of clarity, only the front region of the power tool, with the switching device and the gear linkage, is depicted, while representation of the drive (which is in any event known) has been dispensed with;

FIG. 1*a* shows a side view of a sanding tool that can be used as an alternative to the sanding tool according to FIG. 1, in particular when the power tool is switched over to rotational drive; and FIG. 2 shows a plan view of the right-angle gear linkage and the oscillation drive from above, in a highly simplified representation without the housing and other details, so as to elucidate the principle of the device for switching between oscillation drive and rotational drive.

SPECIFIC DESCRIPTION

The power tool depicted in FIGS. 1 to 2 is designed as a handheld sander, and is labeled overall with the number 10.

Arranged inside a housing 17 is a drive shaft 14, which is driven by a drive motor, schematically denoted by 11, which may be, for example, an electric motor. Arranged at right angles to the drive shaft 14 is an oscillatory tool drive shaft 12, to whose end projecting outward from the housing 17 can be fastened an oscillatory tool 62 that can be driven in an oscillating manner. Provided coaxially with the oscillatory tool drive shaft 12 is a hollow shaft 50 which coaxially surrounds the tool drive shaft 12 and comprises a rotary tool receptacle 48 which projects out of the housing 17.

The rotary tool receptacle 48 possesses a mount 56, arranged eccentrically with respect to the lengthwise axis 13 of the oscillatory tool drive shaft 12, to receive a rotary tool 64 driven in eccentric rotation (cf. FIG 1*a*).

The rotary motion of the drive shaft 14 about its lengthwise axis 15, indicated by tile arrow 16, can be converted either into a rotary motion of the rotary tool receptacle 48 by means of a right-angle gear linkage, or into an oscillating pivoting motion of the oscillatory tool drive shaft 12 by means of an oscillation gear linkage.

The rotary tool receptacle 48 comprises a receptacle block 49, arranged outside the housing 17, that is integrally attached to the hollow shaft 50 which projects into the housing 17 and is non-rotatably attached, for example in a threaded manner, to an output pinion 26 of the oscillation gear linkage, in a manner not depicted further. The hollow shaft 50 is rotatably mounted on the oscillatory tool drive shaft 12 b means of two bearings 19, 21. The oscillatory tool drive shaft 12 is in turn mounted at one end directly to the housing 17 by means of a bearing 18, while at the other end it is retained by the hollow shaft 50, which is rotatably mounted on the housing 17 by means of a bearing 20.

A switching element labeled overall with the number 30 is provided to switch between the two drive capabilities. In the first switch position of the switching element 30, as indicated by the number 31, the oscillation gear linkage, which will be described in greater detail below, is in working engagement with the drive shaft 14 and the oscillatory tool drive shaft 12 so as to drive the latter in an oscillating manner about its lengthwise axis 13 with a small pivot angle and at high frequency (approximately 10,000–25,000 vibrations/minute) . On the other hand, in the second switch position of the switching element 30, as indicated by the dashed lines and the number 32, the bevel gear linkage consisting of a drive pinion 24 and the output gear 26 is in working engagement with the drive shaft 14 and the hollow shaft 50. In the second switching position 32, the rotary tool receptacle is therefore driven rotationally about the lengthwise axis 13.

At its end facing the tool drive shaft 12, the drive shaft 14 is mounted in a bearing 22 such that it can be displaced along its lengthwise axis 15, and carries an eccentric element 28 attached non-rotatably to the drive shaft 14 and, with a gap 44 in front of it, the drive pinion 24, which is configured as a bevel gear and terminates the drive shaft 14 in the direction of the oscillatory tool drive shaft 12.

As is more clearly evident from FIG. 2, the oscillation drive possesses a pivot element 66 that is rigidly and non-rotatably attached, for example by means of a pin attachment 67, to the oscillatory tool drive shaft 12, and that comprises two pivot arms 68, 70 which face toward the drive shaft 14. Formed between the two pivot arms 68, 70 is a recess 72 within which the drive pinion 24 and the eccentric element 28 can be displaced by the drive shaft 14 along their lengthwise axis 15, as indicated by the arrow 78.

A sliding surface 74, 76, oriented inward toward the lengthwise axis 15, is provided at the end of each pivot arm 68, 70. In the first switch position 31, which is depicted with solid lines in FIG. 1, the two pivot arms 68, 70 of the pivot element 66 surround the eccentric element 28 externally in such a way that the two sliding surfaces 74, 76 contact the eccentric element 28 externally so as to slide against it. When the drive shaft 14 is rotationally driven about its lengthwise axis 15, the rotary motion of themdrive shaft 14 is thus converted into an oscillating pivoting motion of the oscillatory tool drive shaft 12 about its lengthwise axis 13. In this first switching position 31, the drive pinion 24 is spaced away from the output gear 26, abolishing the working engagement of the bevel gear linkage.

In the second switching position 32, however, which is depicted with dashed lines in Figure i and solid lines in FIG. 2, the drive shaft 14 is displaced toward the oscillatory tool drive shaft 12 so that on the one hand the drive pinion 24 meshes with the output gear 26, and on the other hand the eccentric element 28 can move freely within the recess 72 of the pivot element 66 without touching the pivot arms 68, 70. Thus while the rotary motion of the drive shaft 14 is converted into a rotary motion of the tool receptacle, the working engagement of the oscillation gear linkage is thereby abolished.

Thus, in order to switch between oscillation drive for the oscillatory tool drive shaft 12 and rotational drive for the hollow shaft 50, the drive shaft 14 is displaced along its lengthwise axis 15 as indicated by the arrow 78.

The switching element 30 by means of which the drive shaft 14 is displaced possesses a slider 40, arranged on the outside of the housing, that can be displaced parallel to the lengthwise axis 15. Attached to the slider 40, for example in a threaded manner, is a right-angle element 42 one of whose arms projects into the interior of the housing 17 and is arranged perpendicular to the drive shaft 14. This arm possesses a projection 44 that projects into the gap formed between drive pinion 24 and eccentric element 28. When slider 40 is displaced, the drive shaft 14 with its drive pinion 24 and eccentric element 28 is therefore also displaced along its lengthwise axis 15.

To allow the drive shaft 14 to be fastened in either the first switching position 31 or the second switching position 32, a locking lever 33 is provided, which is fastened pivotedly onto the slider 40 and engages, with a locking lug 34, either into a groove 38 (in the first switching position 31), or into a groove 36 on the housing 17 (in the second switching position 32).

A central thread 52, into which the tool 62 can be threaded by means of a set screw 60, is provided on the outer end of the tool drive shaft 12 as a mount 58 for the tool 62. It is of course understood that numerous possibilities exist for fastening the tools to the oscillatory tool drive shaft 12 or to the hollow shaft 50, respectively, although they will not be explained further here since they are known to the person skilled in the art and are not part of the invention.

Arranged in the receptacle block 49 is a mount 56 in the form of a blind tapped hole 54, which is laterally offset from the lengthwise axis 13 of the oscillatory tool drive shaft 12 and receptacle block 49. When the rotary tool receptacle 48 is driven rotationally, a rotary tool 64, indicated in FIG. 1*a*, that is inserted into this mount 56 therefore moves not only rotationally but also eccentrically. The eccentricity depends on the radial distance between the lengthwise axis 13 and the receptacle 56.

The oscillatory tool depicted in FIG. 1 is configured as a sanding tool with a triangular sanding surface, each of whose outer edges are curved convexly outward.

It is of course understood that any other tools and sanding surface shapes are also possible. An oscillatory tool 62 of this kind is, however, particularly suitable, if driven in an oscillating manner, for working along lengthwise edges, in corners, or in other poorly accessible locations.

Alternatively, a larger sanding tool, for example in the form of a sanding disk, could be fastened to the rotary tool receptacle 48 coaxially with the lengthwise axis 13, for which purpose a central thread (not depicted) should be provided so as to drive the rotary tool rotationally only.

If, however, the rotary tool 64, which according to FIG. 1*a* is configured as a sanding disk, is fastened to the receptacle 56 that is offset laterally from the lengthwise axis 13, the power tool can then be used as an orbital sander, for example in order to work on the surface of large sanding areas.

It is further understood that a suction device to aspirate sanding dust can also be provided if necessary or desired. Depiction of such a suction device was dispensed with, however, since it is known to the person skilled in the art and is not part of the invention.

We claim:

1. Power tool comprising:

a motor having a drive shaft;

an oscillation drive for driving an oscillation tool in an oscillating manner about a pivot axis;

a rotary drive for rotationally driving a rotary tool;

engaging means coupling said drive shaft to said oscillation drive when in a first switching position, and coupling said drive shaft to said rotary drive when in a second switching position; and a switching element for moving said engaging means between said first and second switching positions.

2. Power tool according to claim 1, wherein said oscillation drive comprises a oscillatory tool drive shaft having an oscillatory tool receptacle, and wherein said rotary drive comprises a rotary tool drive shaft having a rotary tool receptacle.

3. Power tool according to claim 2, wherein said rotary tool receptacle is configured coaxially with the rotary tool drive shaft, and mounted on the tool drive shaft.

4. Power tool according to claim 3, wherein the rotary tool receptacle is attached non-rotatably to an output gear of said rotary drive by means of a hollow shaft rotatably mounted on said oscillatory tool drive shaft.

5. Power tool according to claim 2, wherein the rotary tool receptacle carries a mount, arranged offset from a central axis of said rotary tool drive shaft for receiving said rotary tool, so as to drive said rotary tool in an eccentric rotation about the center axis of said rotary tool drive shaft with said switching element in said second switching position.

6. Power tool according to claim 2, wherein said oscillatory tool receptacle is arranged centrally on one end of said oscillation tool drive shaft.

7. Power tool according to claim 1, wherein said oscillatory tool drive shaft is oriented perpendicular to the drive shaft; wherein said oscillation drive comprises an eccentric element attached non-rotatably to the drive shaft and a pivot element attached non-rotatably to the oscillatory tool drive shaft; and wherein said eccentric element engages said pivot element in said first switching position for oscillatingly driving said oscillatory tool drive shaft about said pivot axis.

8. Power tool according to claim 7, further comprising a drive pinion attached non-rotatably to the drive shaft and an output gear attached non-rotatably to the rotary tool receptacle; wherein said drive pinion engages said output gear for driving said rotary tool drive shaft when said switching element is in said second switching position, while said pivot element is not in working engagement with said eccentric element.

9. Power tool according to claim 8, wherein said drive shaft is arranged axially displaceable along a lengthwise axis thereof, so as to effect engaging of said eccentric element with said pivot when said switching element is in said first switching position, and to effect engaging of said drive pinion with said output gear when said switching element is in said second switching position.

10. Power tool according to claim 9, wherein said drive pinion is arranged at one end of said drive shaft facing the rotary tool drive shaft, next to said eccentric element and spaced away from the latter by a gap; wherein said switching element comprises a projection, engaging into said gap to effect axial displacement of said drive shaft when said switching element is moved between said first and second switching positions.

11. Power tool according to claim 7, wherein said pivot element is configured as a pivot fork having two pivot arms extending opposite to one another and forming a recess therebetween, said pivot fork mounted non-rotatably on said oscillatory tool drive shaft such that the two pivot arms face said drive shaft, said recess allowing displacement of said drive pinion and said eccentric element therein when said drive shaft is axially displaced; each of said pivot arms comprising a sliding surface facing inwardly toward the drive shaft, such that in the first switching position, the sliding surfaces surround the eccentric element externally and are in sliding contact therewith, and such that in the second switching position, the drive shaft is displaced toward the oscillatory tool drive shaft so that the eccentric element can rotate freely within the recess, while said engaging means couples said drive shaft to said rotary drive.

12. Power tool according to claim 1, wherein the switching element can be locked in said first or second switching position.

13. Power tool according to claim 1, wherein the rotary tool is a sanding disk.

14. Power tool according to claim 1, wherein the oscillatory tool is a sanding tool having a polygonal sanding surface.

* * * * *